US011444400B2

(12) United States Patent
Ziegler, IV et al.

(10) Patent No.: US 11,444,400 B2
(45) Date of Patent: Sep. 13, 2022

(54) INFORMATION HANDLING SYSTEM WITH A PRINTED CIRCUIT BOARD HAVING AN EMBEDDED INTERCONNECT

(71) Applicant: DELL PRODUCTS, LP, Round Rock, TX (US)

(72) Inventors: Charles W. Ziegler, IV, Framingham, MA (US); Stephen E. Strickland, Foxborough, MA (US); Jason Pritchard, Hopkinton, MA (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 17/128,848

(22) Filed: Dec. 21, 2020

(65) Prior Publication Data

US 2022/0200179 A1 Jun. 23, 2022

(51) Int. Cl.
*H01R 12/72* (2011.01)
*H01R 13/518* (2006.01)
(Continued)

(52) U.S. Cl.
CPC ..... *H01R 12/724* (2013.01); *H01R 12/7005* (2013.01); *H01R 12/79* (2013.01); *H01R 13/518* (2013.01)

(58) Field of Classification Search
CPC .... H01R 12/75; H01R 12/712; H01R 12/714; H01R 12/716; H01R 12/727; H01R 12/724; H01R 12/7005; H01R 12/79; H05K 3/368
(Continued)

(56) References Cited

U.S. PATENT DOCUMENTS 4,736,266 A * 4/1988 Tanibe ..... H05K 9/0039 361/816
4,770,641 A * 9/1988 Rowlette ..... H05K 3/368 439/86
(Continued)

FOREIGN PATENT DOCUMENTS

CN 102394398 A * 3/2012 ..... H01R 12/52
JP 2018092774 A * 6/2018 ..... H01R 12/7076
(Continued)

OTHER PUBLICATIONS

Goldheart, Apple's Last Dance With Intel_iMac 27" 2020 Teardown (With X-rays)—iFixit; Aug. 10, 2020; https://www.ifixit.com/News/43287/apples-last-dance-with-intel-imac-27-2020-teardown-with-x-rays, (17 pgs).

*Primary Examiner* — Marcus E Harcum
(74) *Attorney, Agent, or Firm* — Larson Newman, LLP

(57) ABSTRACT

An information handling system includes first and second printed circuit boards (PCBs), and first and second connectors. The first PCB includes a first top surface, a first bottom, and a first plurality of side surfaces extending between the first top and first bottom surfaces. The first connector is embedded within the first PCB, and extends from the first bottom surface toward the first top surface. A first height of the first connector is substantially equal to a first thickness of the first PCB. The second PCB includes a second top surface, a second bottom, and a second plurality of side surfaces extending between the second top and second bottom surfaces. The second connector is embedded within the second PCB, and extends from the second bottom surface toward the second top surface. A second height of the second connector is greater than a second thickness of the second printed circuit board.

17 Claims, 6 Drawing Sheets

(51) Int. Cl.
*H01R 12/70* (2011.01)
*H01R 12/79* (2011.01)

(58) Field of Classification Search
USPC ..... 439/74
See application file for complete search history.

(56) References Cited

U.S. PATENT DOCUMENTS 6,188,583 B1 * 2/2001 Fendt ..... H05K 1/142 361/752
8,130,511 B2 * 3/2012 Sato ..... H01R 12/714 361/785
8,545,237 B2 * 10/2013 Johnson ..... H01R 12/585 439/75
10,681,817 B2 * 6/2020 Long ..... H05K 3/34
10,720,734 B2 * 7/2020 Little ..... H01R 13/6587
2004/0183186 A1 * 9/2004 Hirose ..... H01L 23/13 257/690
2007/0228110 A1 * 10/2007 Eldridge ..... H01L 22/20 228/180.5
2007/0285907 A1 * 12/2007 Nishikawa ..... H05K 1/183 361/763
2011/0089553 A1 * 4/2011 Kim ..... H01L 23/13 257/686
2014/0042489 A1 * 2/2014 Preuschl ..... H01L 33/64 257/99
2015/0303598 A1 * 10/2015 Jeon ..... H01R 13/6587 439/65
2016/0050756 A1 2/2016 Mundt et al.
2018/0248286 A1 * 8/2018 Naemura ..... H01R 12/79
2019/0317555 A1 * 10/2019 Schnell ..... G06T 1/20
2020/0067219 A1 * 2/2020 Mische ..... H05K 1/142
2021/0194161 A1 * 6/2021 Duan ..... H01R 12/714

FOREIGN PATENT DOCUMENTS

JP 2020053140 A * 4/2020 ..... H01R 12/55
TW 201136035 A * 10/2011

* cited by examiner

INFORMATION HANDLING SYSTEM WITH A PRINTED CIRCUIT BOARD HAVING AN EMBEDDED INTERCONNECT

FIELD OF THE DISCLOSURE

The present disclosure generally relates to information handling systems, and more particularly relates to an information handling system with a printed circuit board having an embedded interconnect.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems. Information handling systems can also implement various virtualized architectures. Data and voice communications among information handling systems may be via networks that are wired, wireless, or some combination.

SUMMARY

An information handling system includes first and second printed circuit boards (PCBs), and first and second connectors. The first PCB includes a first top surface, a first bottom, and a first plurality of side surfaces extending between the first top and first bottom surfaces. The first connector may be embedded within the first PCB, and may extend from the first bottom surface toward the first top surface. A first height of the first connector may be substantially equal to a first thickness of the first PCB. The second PCB includes a second top surface, a second bottom, and a second plurality of side surfaces extending between the second top and second bottom surfaces. The second connector may be embedded within the second PCB, and may extend from the second bottom surface toward the second top surface. A second height of the second connector is greater than a second thickness of the second printed circuit board.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1:
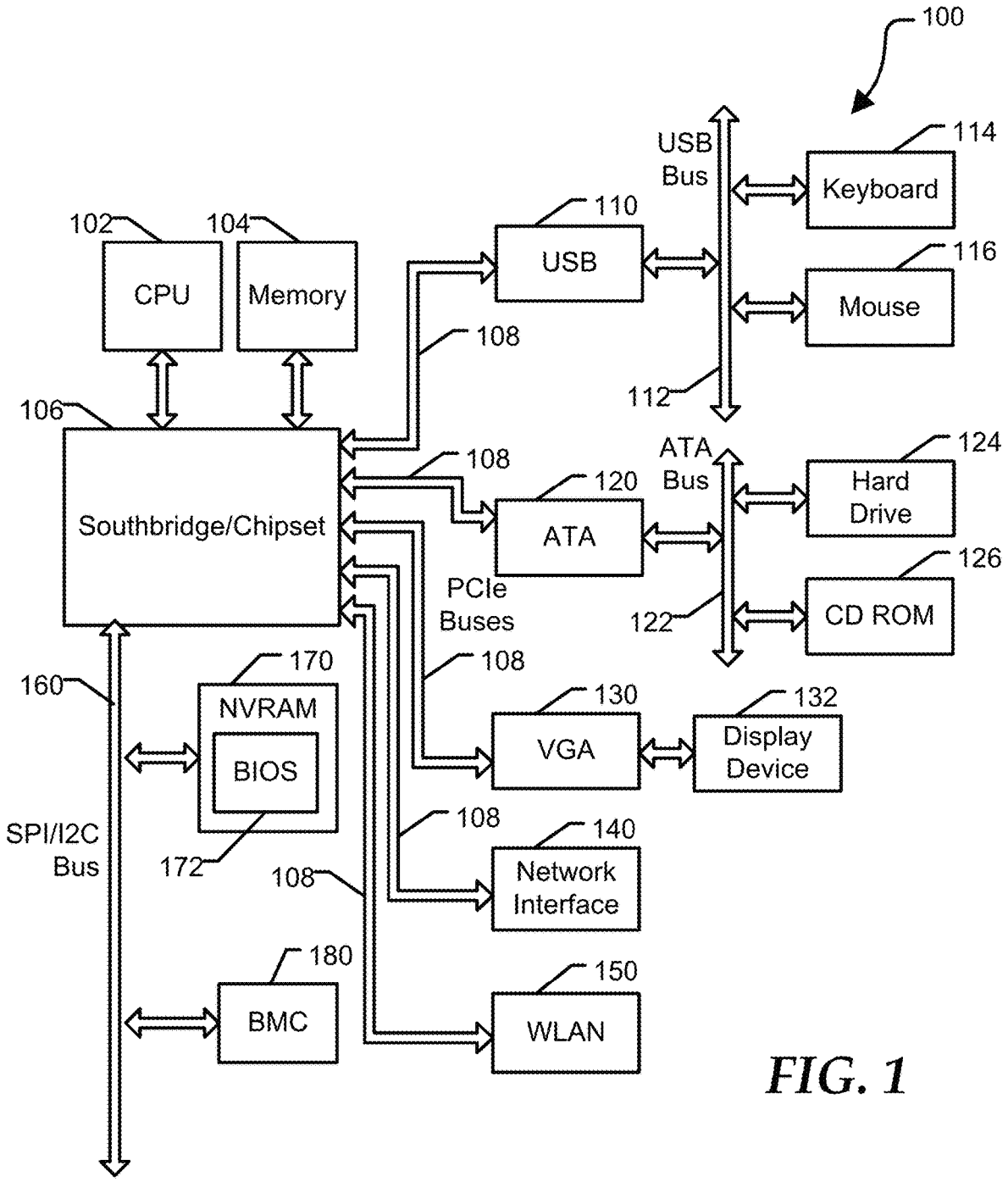
FIG. 1 is a block diagram of a general information handling system according to an at least one embodiment of the present disclosure.

FIG. 1 illustrates a general information handling system or server 100 according to at least one embodiment of the disclosure. For purpose of this disclosure information handling system can include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system can be a personal computer, a laptop computer, a smart phone, a tablet device or other consumer electronic device, a network server, a network storage device, a switch, a router, or another network communication device, or any other suitable device and may vary in size, shape, performance, functionality, and price.

Information handling system 100 including a processor 102, a memory 104, a southbridge/chipset 106, one or more PCIe buses 108, a universal serial bus (USB) controller 110, a USB 112, a keyboard device controller 114, a mouse device controller 116, a configuration an ATA bus controller 120, an ATA bus 122, a hard drive device controller 124, a compact disk read only memory (CD ROM) device controller 126, a video graphics array (VGA) device controller 130, a network interface controller (NIC) 140, a wireless local area network (WLAN) controller 150, a serial peripheral interface (SPI) bus 160, a NVRAM 170 for storing BIOS 172, and a baseboard management controller (BMC) 180. In an example, chipset 106 may be directly connected to an individual end point via a PCIe root port within the chipset and a point-to-point topology as shown in FIG. 1. BMC 180 can be referred to as a service processor or embedded controller (EC). Capabilities and functions provided by BMC 180 can vary considerably based on the type of information handling system. For example, the term baseboard management system is often used to describe an embedded processor included at a server, while an embedded controller is more likely to be found in a consumer-level device. As disclosed herein, BMC 180 represents a processing device different from CPU 102, which provides various management functions for information handling system 100. For example, an embedded controller may be responsible for power management, cooling management, and the like. An embedded controller included at a data storage system can be referred to as a storage enclosure processor.

System 100 can include additional processors that are configured to provide localized or specific control functions, such as a battery management controller. Bus 160 can include one or more busses, including a SPI bus, an I2C bus, a system management bus (SMBUS), a power management bus (PMBUS), and the like. BMC 180 can be configured to provide out-of-band access to devices at information handling system 100. As used herein, out-of-band access herein refers to operations performed prior to execution of BIOS 172 by processor 102 to initialize operation of system 100.

BIOS 172 can be referred to as a firmware image, and the term BIOS is herein used interchangeably with the term firmware image, or simply firmware. BIOS 172 includes instructions executable by CPU 102 to initialize and test the hardware components of system 100, and to load a boot loader or an operating system (OS) from a mass storage device. BIOS 172 additionally provides an abstraction layer for the hardware, such as a consistent way for application programs and operating systems to interact with the keyboard, display, and other input/output devices. When power is first applied to information handling system 100, the system begins a sequence of initialization procedures. During the initialization sequence, also referred to as a boot sequence, components of system 100 are configured and enabled for operation, and device drivers can be installed. Device drivers provide an interface through which other components of the system 100 can communicate with a corresponding device.

Information handling system 100 can include additional components and additional busses, not shown for clarity. For example, system 100 can include multiple processor cores, audio devices, and the like. While a particular arrangement of bus technologies and interconnections is illustrated for the purpose of example, one of skill will appreciate that the techniques disclosed herein are applicable to other system architectures. System 100 can include multiple CPUs and redundant bus controllers. One or more components can be integrated together. For example, portions of southbridge/chipset 106 can be integrated within CPU 102. Additional components of information handling system 100 can include one or more storage devices that can store machine-executable code, one or more communications ports for communicating with external devices, and various input and output (I/O) devices, such as a keyboard, a mouse, and a video display. An example of information handling system 100 includes a multi-tenant chassis system where groups of tenants (users) share a common chassis, and each of the tenants has a unique set of resources assigned to them. The resources can include blade servers of the chassis, input/output (I/O) modules, Peripheral Component Interconnect-Express (PCIe) cards, storage controllers, and the like.

Information handling system 100 can include a set of instructions that can be executed to cause the information handling system to perform any one or more of the methods or computer based functions disclosed herein. The information handling system 100 may operate as a standalone device or may be connected to other computer systems or peripheral devices, such as by a network.

In a networked deployment, the information handling system 100 may operate in the capacity of a server or as a client user computer in a server-client user network environment, or as a peer computer system in a peer-to-peer (or distributed) network environment. The information handling system 100 can also be implemented as or incorporated into various devices, such as a personal computer (PC), a tablet PC, a set-top box (STB), a personal digital assistant (PDA), a mobile device, a palmtop computer, a laptop computer, a desktop computer, a communications device, a wireless telephone, a land-line telephone, a control system, a camera, a scanner, a facsimile machine, a printer, a pager, a personal trusted device, a web appliance, a network router, switch or bridge, or any other machine capable of executing a set of instructions (sequential or otherwise) that specify actions to be taken by that machine. In a particular embodiment, the computer system 100 can be implemented using electronic devices that provide voice, video or data communication. Further, while a single information handling system 100 is illustrated, the term "system" shall also be taken to include any collection of systems or sub-systems that individually or jointly execute a set, or multiple sets, of instructions to perform one or more computer functions.

The information handling system 100 can include a disk drive unit and may include a computer-readable medium, not shown in FIG. 1, in which one or more sets of instructions, such as software, can be embedded. Further, the instructions may embody one or more of the methods or logic as described herein. In a particular embodiment, the instructions may reside completely, or at least partially, within system memory 104 or another memory included at system 100, and/or within the processor 102 during execution by the information handling system 100. The system memory 104 and the processor 102 also may include computer-readable media.

Figure 2:
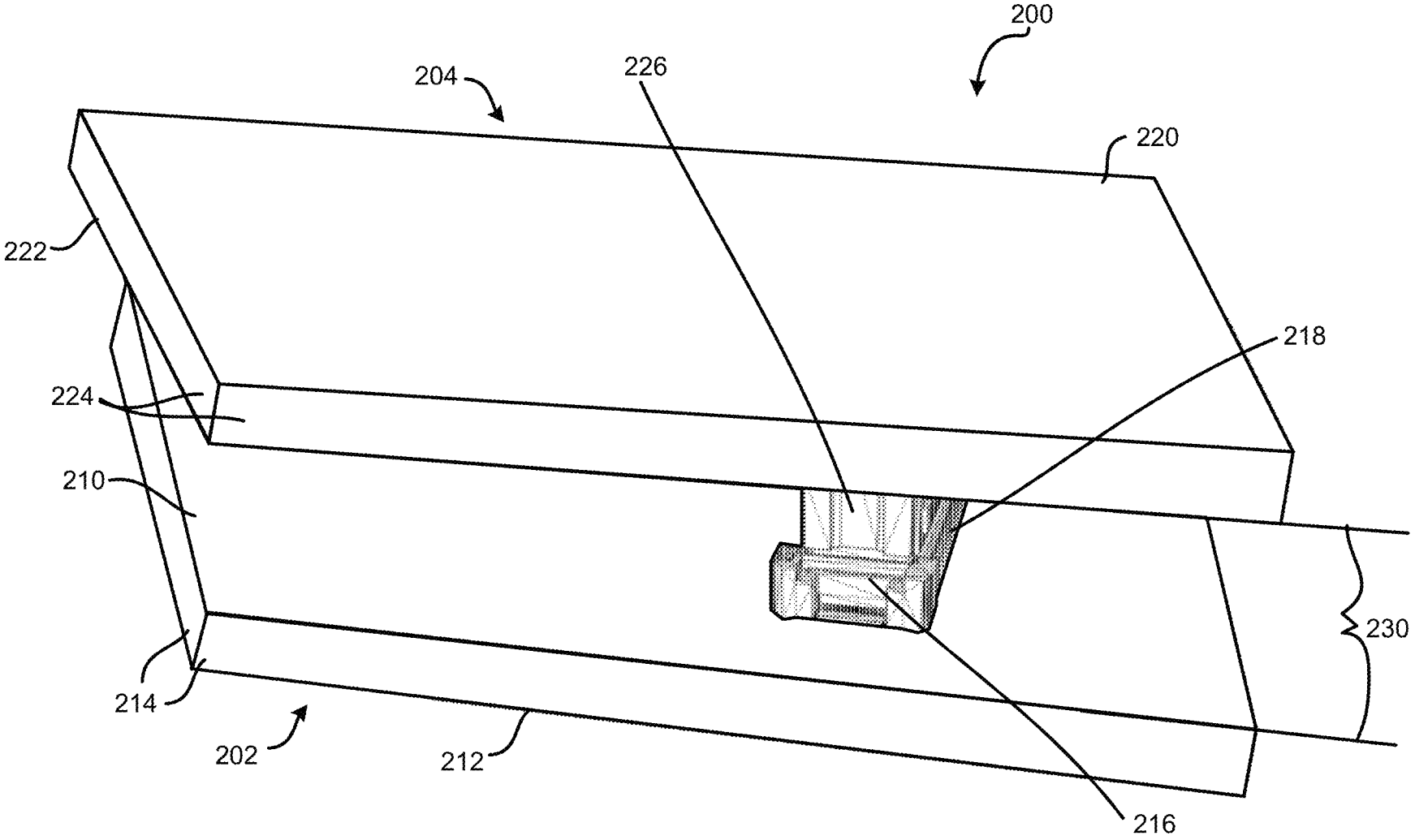
FIG. 2 (Prior Art)
FIG. 2 is a perspective view of two printed circuit boards in communication via connectors.

FIG. 2 illustrates a system 200 including printed circuit boards 202 and 204 in communication via connectors. Printed circuit board 202 includes multiple surfaces including a top surface 210, a bottom surface 212, and multiple side surfaces 214. A connector 216 is mounted to top surface 210 of printed circuit board 202 via mounting pins/pads 218. Mounting pins/pads 218 of connector 216 are mounted as surface mounts on top surface 210. Mounting pins/pads 218 may enable communication between components of printed circuit board 202 and any device coupled to connector 216, such as printed circuit board 204.

Printed circuit board 204 includes multiple surfaces including a bottom surface 220, a top surface 222, and multiple side surfaces 224. A connector 216 is mounted to top surface 222 of printed circuit board 204 via pins/pads. The mounting pins/pads of connector 226 are mounted as surface mounts on top surface 222. The mounting pins/pads of connector 226 may enable communication between components of printed circuit board 204 and any device coupled to the connector, such as printed circuit board 202.

Connectors 216 and 226 play a critical role in an overall size of an enclosure of system 200, such as an information handling system. The overall size of an information handling system enclosure may be effected by a distance 230 between printed circuit boards 202 and 204 created by the height of connectors 216 and 226. Distance 230 between printed circuit boards 202 and 204 is directly proportional to the height of connectors 216 and 226. While distance 230 is illustrated in FIG. 2 with respect to printed circuit board 202 mated to printed circuit board 204, the distance may also be associated with respect to a printed circuit board mated to a cable board.

In previous information handling systems, such as system 200, distance 230 could any length, such as approximately two hundred millimeters. In these previous information handling systems, distance 230 may be reduced by connectors 216 and 226 being ultra-low profile connectors. While distance 230 between mated printed circuit boards 202 and 204 may be reduced with ultra-low profile connectors 216 and 226, these ultra-low profile connectors may result in challenges within an information handling system. These challenges include a reduced robustness of connectors 202 and 204 caused by the shorter pin length within the ultra-low profile connectors. The reduced robustness may affect connectors 216 and 226 during insertion and removal of printed circuit boards 202 and 204, and caused by other suitable environmental conditions. The reduced pin height within connectors 216 and 226 may cause shock and vibration issues with the connectors and printed circuit boards 202 and 204. Additionally, low profile connectors may be blind mated, such that extra mechanical features to help align the mating connectors. These extra mechanical features may be part of or in addition to the connectors. However, printed circuit boards mated together within an information handling system may be improved by reducing a distance between the printed circuit board to a very small distance and even to approximately zero millimeters without shorten the length of pins without the connector. As described below, this decreased distance may be achieved with connectors with typical pin heights by embedding the connectors within the printed circuit boards.

Figure 3:
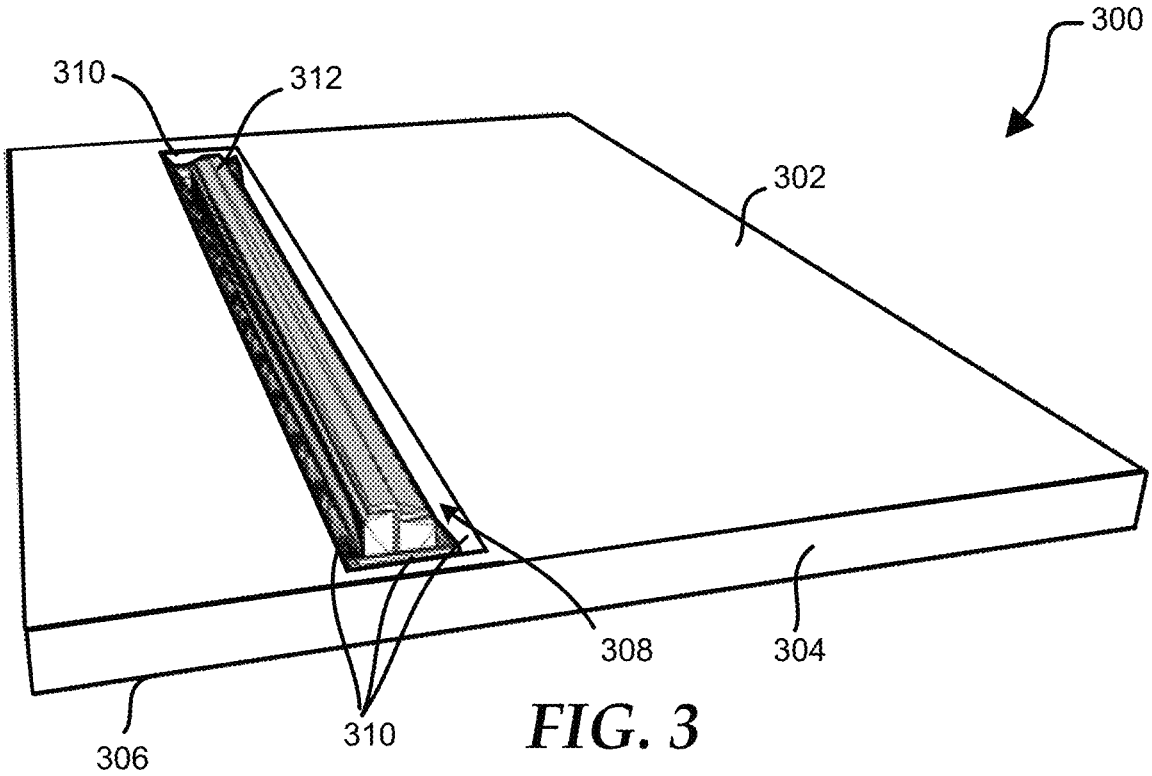
FIGS. 3 and 4 are perspective views of a first printed circuit board with an embedded connector according to at least one embodiment of the disclosure.
Figure 4:
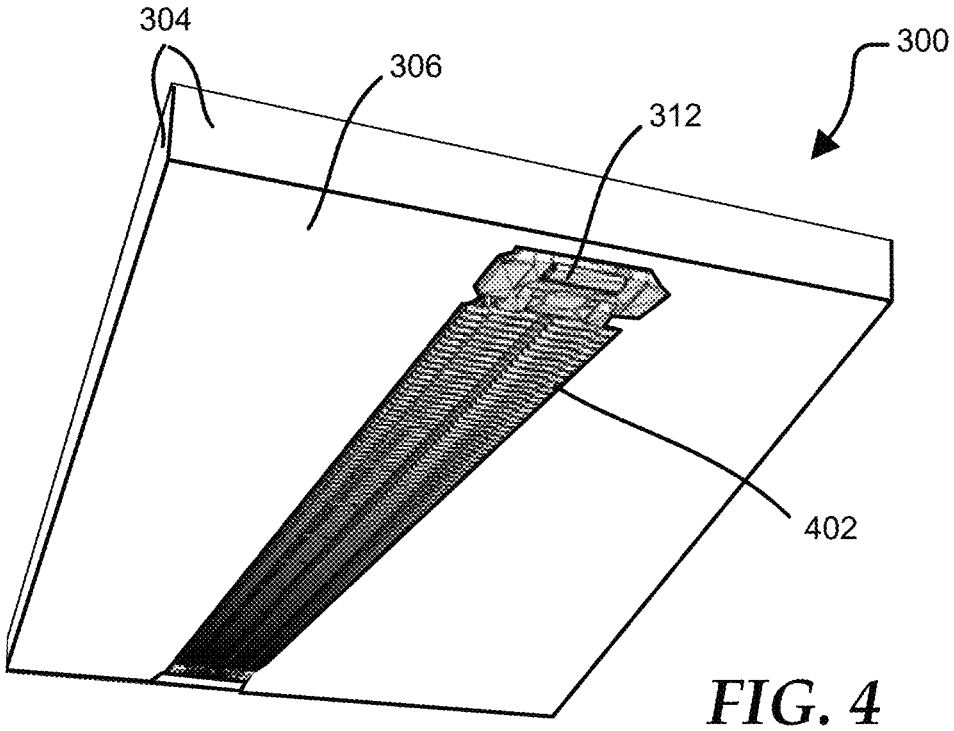

FIGS. 3 and 4 illustrate a printed circuit board 300 according to at least one embodiment of the disclosure. As shown in FIG. 3, printed circuit board 300 includes a top surface 302, side surfaces 304, a bottom surface 306, and a hole or opening 308. In an example, hole 308 may extend from top surface 302 through printed circuit board 300 to bottom surface 306. Hole 308 may be formed from surfaces 310 that extend perpendicularly in between top surface 302 and bottom surface 306. In an example, a connector 312 may be embedded within hole 308, such that an amount or length of the connector extending beyond top surface 302 depends on a thickness of printed circuit board 300. For example, if a height of connector 312 is approximately one hundred millimeters and printed circuit board 300 has a thickness of approximately ninety-eight millimeters, then the connector may extend approximately two millimeters. One of ordinary skill in the art would recognize that the height of connector 312 and thickness of printed circuit board 300 are merely exemplary and that any other dimensions are possible without varying from the scope of this disclosure. In certain examples, connector 312 may be embedded within a printed circuit board with any thickness.

Referring now to FIG. 4, connector 312 may be inserted within hole 308 from the bottom of printed circuit board 300. In an example, connector 312 may be placed within hole 308 until mounting pins/pads 402 of the connector are placed in physical and electrical communication with bottom surface 306. In certain examples, mounting pins/pads 402 may be surface mount pins/pads, such that mounting pins/pads 402 may be soldered to surface pads on bottom surface 306. Based on mounting pins/pads 402 being in physical and electrical communication with bottom surface 306, a main portion of connector 312 may be located within hole 308, such that the connector is embedded within printed circuit board 300. In this example, the pins internal to connector 312 may not be much shorter than internal pins of connector 216 in FIG. 2.

In an example, the internal pins of connector 312 may be substantially longer than the internal pins of an ultra-low connector. In this example, the longer pins of connector 312 may provide a greater contact area within connector 312, which in turn may result in the embedded connector having higher environment robustness as compared to an ultra-low connector and a smaller distance between mated printed circuit boards. Additionally, a mechanical structure may be designed stronger based on more space being available for the structure of the printed circuit boards. In an example, the mechanical structure may be any suitable material, such as plastic.

Figure 5:
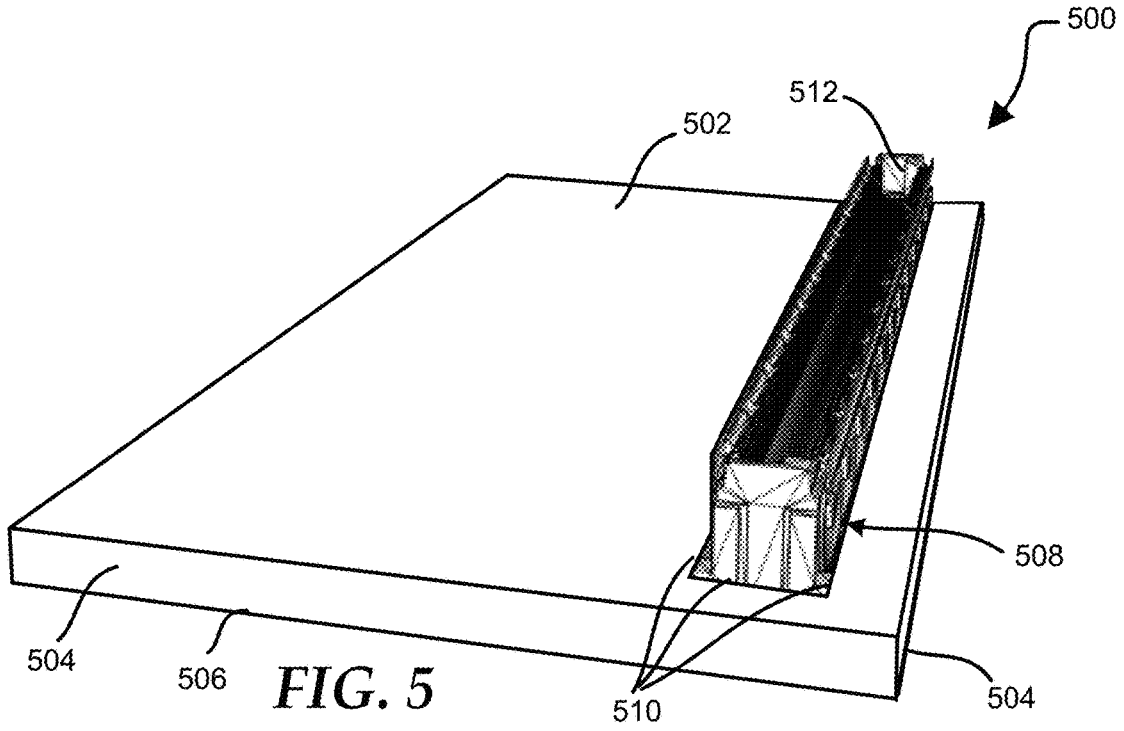
FIGS. 5 and 6 are perspective views of a second printed circuit board with an embedded connector according to at least one embodiment of the disclosure.
Figure 6:
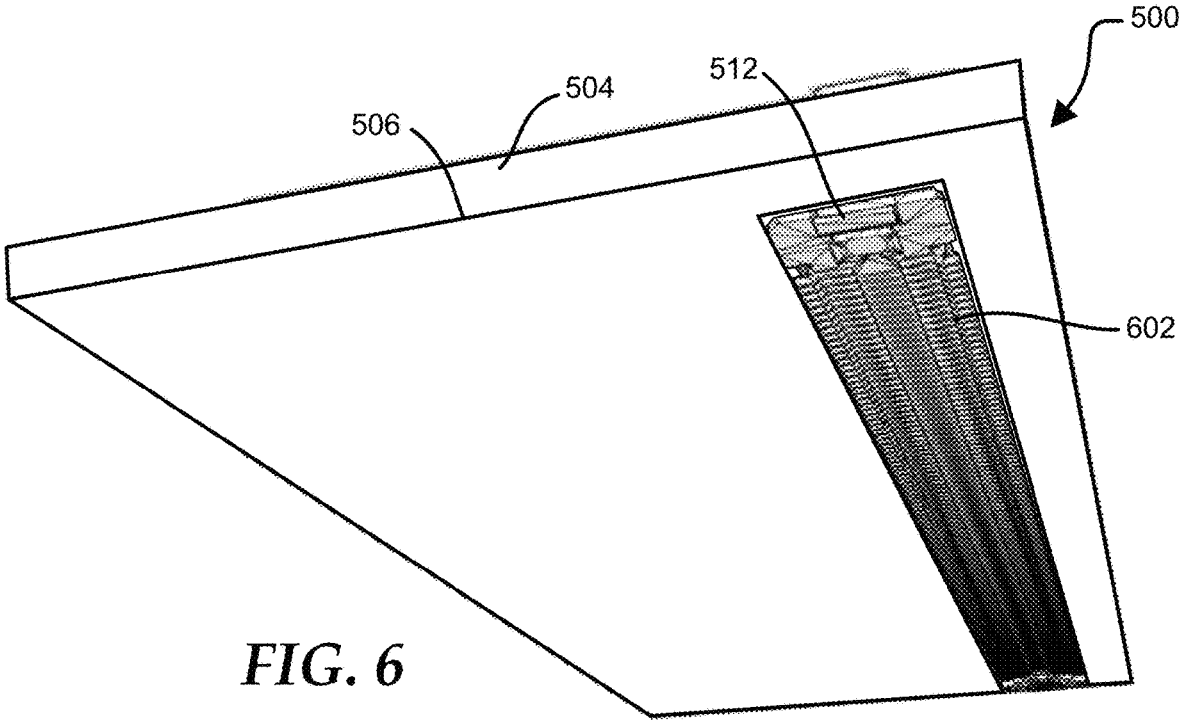

FIGS. 5 and 6 illustrate a printed circuit board 500 according to at least one embodiment of the disclosure. As shown in FIG. 5, printed circuit board 500 includes a top surface 502, side surfaces 504, a bottom surface 506, and a hole 508. In an example, hole 508 may extend from top surface 502 through printed circuit board 500 to bottom surface 506. Hole 508 may include surfaces 510 that extend perpendicularly in between top surface 502 and bottom surface 506. In an example, a connector 512 may be embedded within hole 508, such that an amount of the connector extending beyond top surface 502 depends on a thickness of printed circuit board 500. For example, an amount of connector 512 extending beyond top surface 502 may be substantially equal to the height of the connector minus the thickness of printed circuit board 500. In certain examples, connector 512 may be embedded within a printed circuit board with any thickness. In an example, connector 512 may be referred to as a receptacle connector, such that connector 312 of FIG. 3 may be inserted within connector 512.

Referring now to FIG. 6, connector 512 may be inserted within hole 508 from the bottom of printed circuit board 500. In an example, connector 512 may be placed within hole 508 until mounting pins/pads 602 of the connector are placed in physical and electrical communication with bottom surface 506. In certain examples, mounting pins/pads 602 may be surface mount pins/pads, such that mounting pins/pads 602 may be soldered to surface pads on bottom surface 506. Based on mounting pins/pads 602 being in physical and electrical communication with bottom surface 506, a middle portion of connector 512 may be located within hole 508, such that the connector is embedded within printed circuit board 500, and a top portion of connector 512 may extend beyond top surface 502.

Figure 7:
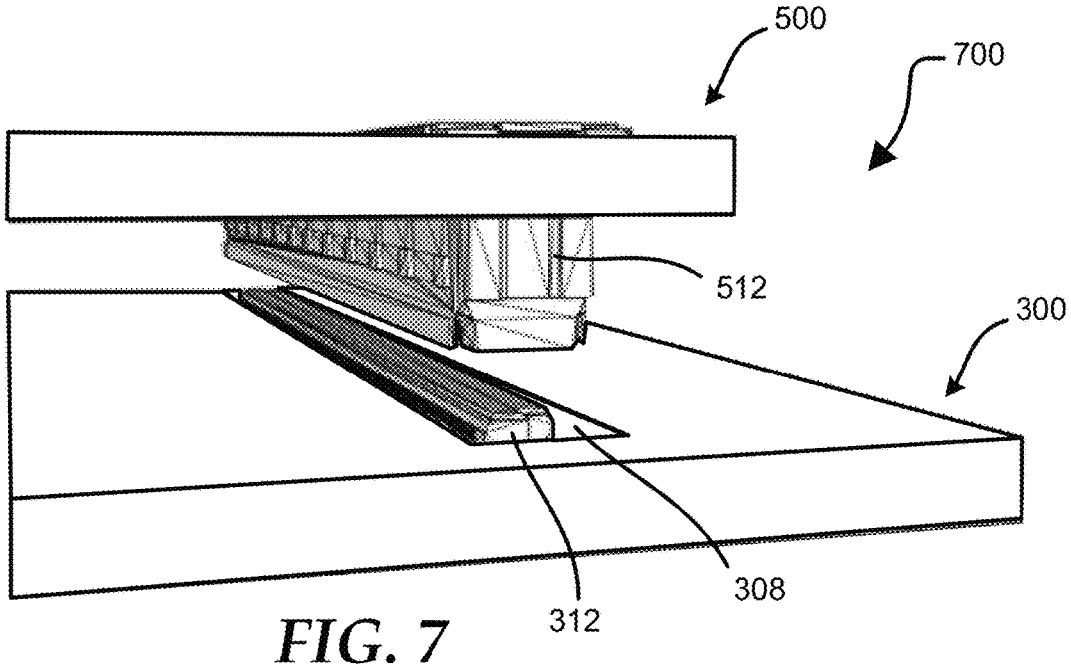
FIG. 7 is a perspective view of the first and second printed circuit boards in a first alignment according to at least one embodiment of the present disclosure.

FIG. 7 illustrates a system 700 including printed circuit boards 300 and 500 according to at least one embodiment of the present disclosure. In an example, system 700 may be any suitable system including, but not limited to, information handling system 100, and printed circuit boards 300 and 500 may be any suitable components with the information handling system. In certain examples, printed circuit board 300 and printed circuit board 500 may be placed in a first alignment as shown in FIG. 7.

Upon connector 512 being aligned above connector 312 and hole 308, printed circuit board 500 may be moved toward printed circuit board 300. In an example, as connectors 312 and 512 start to interface, connector 312 may be inserted within connector 512 and an outer surface of connector 512 may be inserted within hole 308. An individual may continue to push printed circuit boards 300 and 500 together until connectors 312 and 512 are fully mated. In an example, the board to board interface of printed circuit boards 300 and 500 may result in a distance 802 between the printed circuit boards that is substantially smaller than distance 230 shown in FIG. 2.

Figure 8:
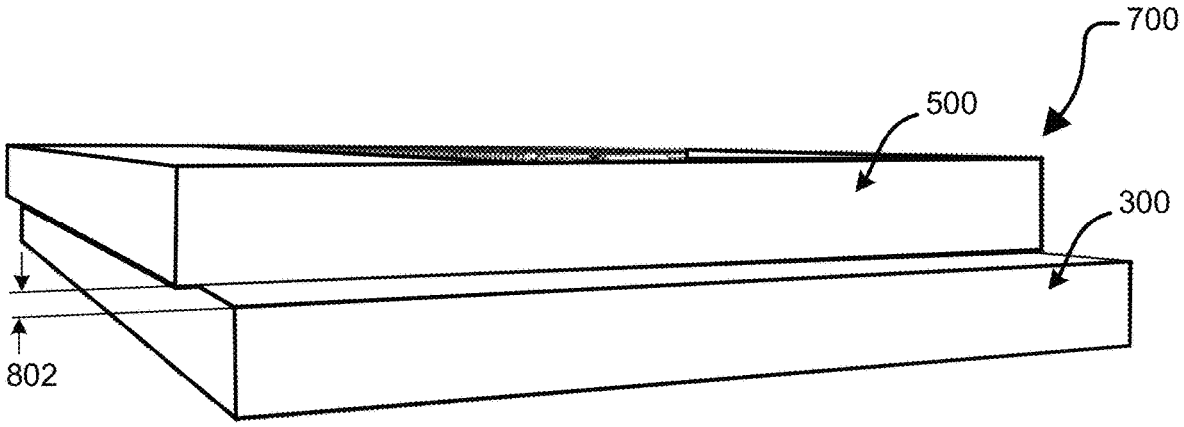
FIG. 8 is a perspective view of the first and second printed circuit boards connected via embedded connectors according to at least one embodiment of the present disclosure.

FIG. 8 illustrates printed circuit boards 300 and 500 fully mated in a board to board connection via embedded connectors 312 and 512 according to an at least one embodiment of the present disclosure. When fully mated, printed circuit boards 300 and 500 may be separated by distance 802. In certain examples, distance 802 may varying based on the thickness of each of printed circuit boards 300 and 500.

In an example, if the thickness of printed circuit board 300 is substantially equal to a height of connector 312 embedded within hole 308, distance 800 may depend on a length of connector 512 that extends beyond printed circuit board 500. For example, if the length of connector 512 extending beyond printed circuit board 500 is substantially equal to the thickness of printed circuit board 300, distance 802 may be a substantially small amount, such as two millimeters, three millimeters, four millimeters, or the like. Thus, embedded connectors 312 and 512 may substantially reduce distance 802 between printed circuit boards 300 and 500 as compared to previous connectors that were not embedded. In this example, based on connector 312 being mounted through printed circuit board 300 and connector 512 being mounted through printed circuit board 500, a constaint total mating height may be maintained between the printed circuit board even if the printed circuit board thickness changes. Based on the constaint mating height, printed circuit boards 300 and 500 may have variable thickness for different solutions and still maintain a overall the same volume in an information handling system.

Figure 9:
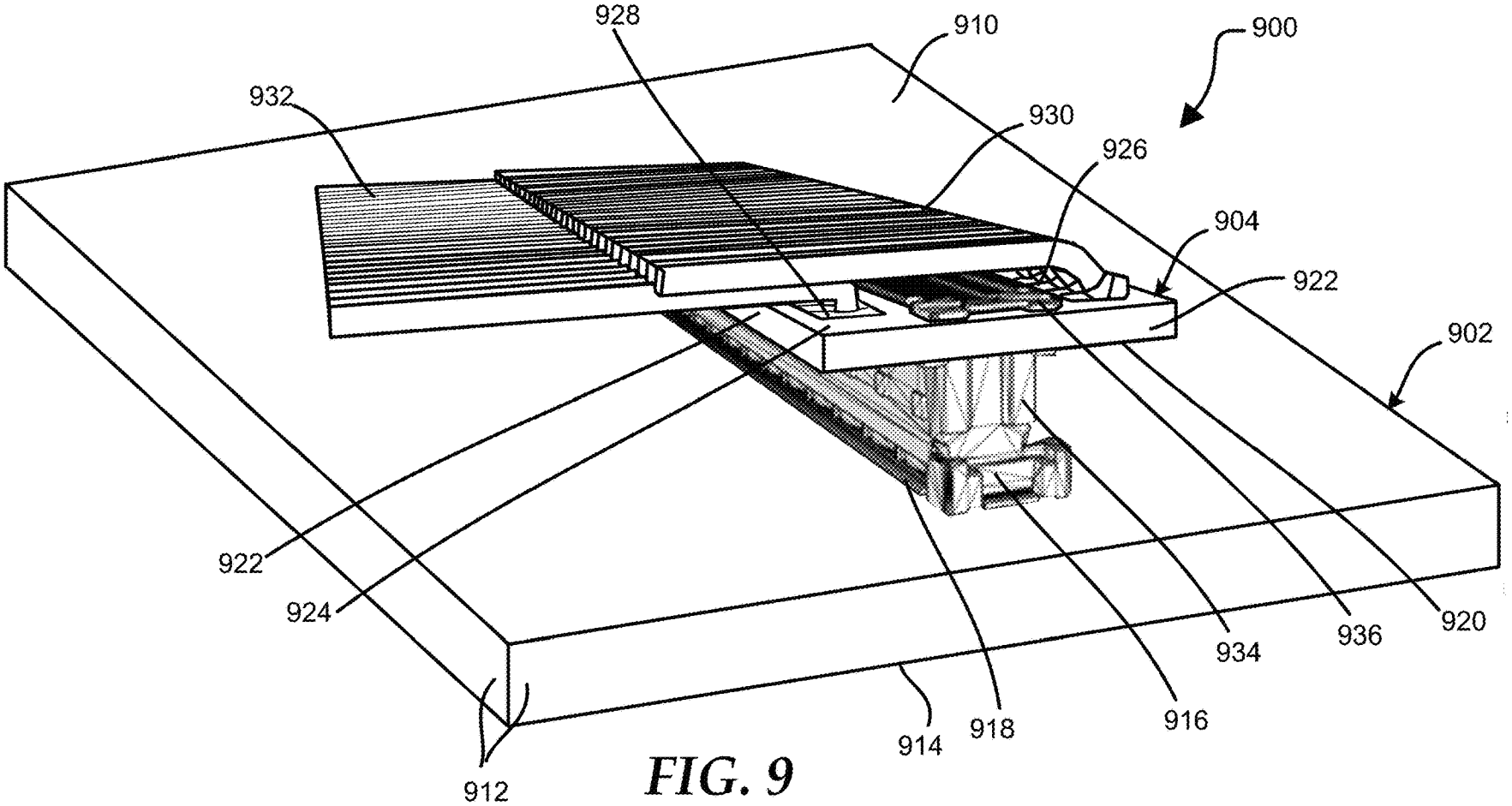
FIG. 9 is a perspective view of a printed circuit board connected to a cable board via embedded connectors according to at least one embodiment of the present disclosure.

FIG. 9 illustrates a system 900 including a printed circuit board 902 connected to a cable board 904 according to an at least one embodiment of the present disclosure. Printed circuit board 902 includes a top surface 910, side surfaces 912, and a bottom surface 914. A connector 916 may be mounted on printed circuit board 902 via mounting pins/pads 918. In certain examples, mounting pins/pads 918 may be surface mount pins/pads, such that mounting pins/pads 918 may be soldered to surface pads on top surface 910. In another example, connector 916 may be embedded within printed circuit board 902 such that mounting pins/pads 918 may be mounted on bottom surface 914 without varying from the scope of this disclosure.

Cable board 904 includes a top surface 920, side surfaces 922, a bottom surface 924, cable termination pads 926 and 928, and sets of cables 930 and 932. A connector 934 may be embedded within printed circuit board 904 via a hole in the printed circuit board. In an example, connector 934 may be embedded within printed circuit board 904 in a substantially similar manner as described above with respect to connector 512 within printed circuit board 500 in FIG. 5. Connector 934 may be connected to bottom surface 924 via mounting pins/pads 936. In certain examples, mounting pins/pads 936 may be surface mount pins/pads, such that mounting pins/pads 936 may be soldered to surface pads on bottom surface 924.

In an example, the routing area on top surface 910 of printed circuit board 902 may not be impacted by an embedded connector solution. Cable board 904 may embed connector 934 without impacting a routing area on bottom surface 924. In an example, the routing area of cable board 904 may not be affected because electrical connections from mounting pins 936 may be routed on a same layer to cable termination pads 926 and 928. In certain examples, routing areas on printed circuit board 902 and cable board 904 may not impacted. However, system 900 may be improve by decreasing a mating height between printed circuit board 902 and cable board 904. For example, the distance between printed circuit board 902 and cable board 904 may be reduce by the thickness of cable board 904 based on connector 934 being embedded within the cable board.

While connector 312 has been discussed with dual sided mounting pins/pads 402 and connector 512 has been discussed with dual sided routing pin/pads 602, the mounting pins/pads may be single sided without varying from the scope of this disclosure. For example, connectors 312 and 512 may include pads only on one side to create a side exit with near zero board to board distance.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

When referred to as a "device," a "module," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device).

The device or module can include software, including firmware embedded at a processor or software capable of operating a relevant environment of the information handling system. The device or module can also include a combination of the foregoing examples of hardware or software. Note that an information handling system can include an integrated circuit or a board-level product having portions thereof that can also be any combination of hardware and software.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. An information handling system comprising:

a first printed circuit board including a first top surface, a first bottom, and a first plurality of side surfaces extending between the first top and first bottom surfaces;

a first connector embedded within the first printed circuit board, the first connector extending from the first bottom surface toward the first top surface, wherein mounting pads of the first connector are mounted on the first bottom surface;

a second printed circuit board including a second top surface, a second bottom, and a second plurality of side surfaces extending between the second top and second bottom surfaces; and a second connector embedded within the second printed circuit board, the second connector to extend from the second bottom surface toward the second top surface, wherein mounting pads of the second connector are mounted on the second top surface, wherein a height of the second connector is substantially greater than a thickness of the second printed circuit board.

2. The information handling system of claim 1, wherein the first printed circuit board and the second printed circuit board are mated by an interface between the first connector and the second connector.

3. The information handling system of claim 1, wherein a distance between the first printed circuit board and the second printed circuit board when mated is determined by a difference between a length that the second connector extends beyond the second printed circuit board and a thickness of the first connector.

4. The information handling system of claim 1, the second printed circuit board further includes:

a third plurality of surfaces extending between the second top and second bottom surfaces, wherein the third plurality of surfaces form a hole within the second printed circuit board, the second connector is located within the second printed circuit board.

5. The information handling system of claim 1, the first printed circuit board further includes:

a second plurality of surfaces extending between the first top and first bottom surfaces, wherein the second plurality of surfaces form a hole within the first printed circuit board, the first connector is located within the hole of the first printed circuit board.

6. An information handling system comprising:

a first printed circuit board including a first top surface, a first bottom, and a first plurality of side surfaces extending between the first top and first bottom surfaces;

a first connector embedded within the first printed circuit board, the first connector extending from the first bottom surface toward the first top surface, wherein mounting pads of the first connector are mounted on the first bottom surface, wherein a first height of the first connector is substantially equal to a first thickness of the first printed circuit board;

a second printed circuit board including a second top surface, a second bottom, and a second plurality of side surfaces extending between the second top and second bottom surfaces; and a second connector embedded within the second printed circuit board, the second connector extending from the second bottom surface toward the second top surface, wherein mounting pads of the second connector are mounted on the second top surface, wherein a second height of the second connector is substantially greater than a second thickness of the second printed circuit board.

7. The information handling system of claim 6, wherein the first printed circuit board and the second printed circuit board are mated by an interface between the first connector and the second connector.

8. The information handling system of claim 6, wherein a distance between the first printed circuit board and the second printed circuit board when mated is determined by a difference between a length that the second connector extends beyond the second printed circuit board and the first thickness of the first connector.

9. The information handling system of claim 6, the second printed circuit board further includes:

a third plurality of surfaces extending between the second top and second bottom surfaces, wherein the third plurality of surfaces form a hole within the second printed circuit board, the second connector is located within the second printed circuit board.

10. The information handling system of claim 1, the first printed circuit board further includes:

a third plurality of surfaces extending between the first top and first bottom surfaces, wherein the third plurality of surfaces form a hole within the first printed circuit board, the first connector is located within the hole of the first printed circuit board.

11. An information handling system comprising:

a printed circuit board including a first top surface, a first bottom, and a first plurality of side surfaces extending between the first top and first bottom surfaces;

a first connector embedded within the printed circuit board, the first connector extending from the first bottom surface toward the first top surface, wherein mounting pads of the first connector are mounted on the first bottom surface;

a cable board including a second top surface, a second bottom surface, and a second plurality of side surfaces extending between the second top and second bottom surfaces; and a second connector embedded within the cable board, the second connector to extend from the second bottom surface toward the second top surface, wherein a height of the second connector is greater than a thickness of the cable board.

12. The information handling system of claim 11, wherein the printed circuit board and the cable board are mated by an interface between the first connector and the second connector.

13. The information handling system of claim 11, wherein a distance between the printed circuit board and the cable board when mated is determined by a difference between a length of the second connector and a thickness of the cable board.

14. The information handling system of claim 11, the cable board further includes:

a third plurality of surfaces extending between the second top and second bottom surfaces, wherein the third plurality of surfaces form a hole within the cable board, the second connector is located within the cable board.

15. The information handling system of claim 11, wherein mounting pads of the second connector are mounted on the second top surface.

16. The information handling system of claim 15, wherein termination pads of a plurality of cables are mounted on the second top surface.

17. The information handling system of claim 15, wherein electrical connection between the mounting pads and the termination pads is on the second top surface.

* * * * *